US006402464B1

(12) United States Patent
Chiu et al.

(10) Patent No.: US 6,402,464 B1
(45) Date of Patent: Jun. 11, 2002

(54) ENHANCED HEAT TRANSFER SURFACE FOR CAST-IN-BUMP-COVERED COOLING SURFACES AND METHODS OF ENHANCING HEAT TRANSFER

(75) Inventors: Rong-Shi Paul Chiu, Glenmont, NY (US); Wayne Charles Hasz, Pownal, VT (US); Robert Alan Johnson, Simpsonville, SC (US); Ching-Pang Lee, Cincinnati, OH (US); Nesim Abuaf, Lincoln City, OR (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 09/650,864

(22) Filed: Aug. 29, 2000

(51) Int. Cl.[7] ..... F04D 31/00

(52) U.S. Cl. ..... 415/116; 228/246; 165/133; 165/908

(58) Field of Search ..... 415/116, 173.1, 415/173.4, 174.4, 170.1; 165/133, 908; 228/245, 246, 247, 248, 249, 250, 251, 252, 253, 254, 255

(56) References Cited

U.S. PATENT DOCUMENTS 5,098,257 A * 3/1992 Hultgren et al. ..... 415/115
5,584,651 A * 12/1996 Pietraszkiewicz et al. .. 415/115
6,165,885 A * 12/2000 Gaynes et al. ..... 438/612

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39$^{th}$ GE Turbine State–of–the–Art Technology Seminar", Tab 2, "GE Heavy–Duty Gas Turbine Performance Characteristics", F. J. Brooks, Aug. 1996.

"39$^{th}$ GE Turbine State–of–the–Art Technology Seminar", Tab 3, "9EC 50Hz 170–MW Class Gas Turbine", A. S. Arrao, Aug. 1996.

"39$^{th}$ GE Turbine State–of–the–Art Technology Seminar", Tab 4, "MWS6001FA—An Advanced–Technology 70–MW Class 50/60 Hz Gas Turbine", Ramachandran et al., Aug. 1996.

"39$^{th}$ GE Turbine State–of–the–Art Technology Seminar", Tab 5, "Turbomachinery Technology Advances at Nuovo Pignone", Benvenuti et al., Aug. 1996.

"39$^{th}$ GE Turbine State–of–the–Art Technology Seminar", Tab 6, "GE Aeroderivative Gas Turbines—Design and Operating Features", M.W. Horner, Aug. 1996.

"39$^{th}$ GE Turbine State–of–the–Art Technology Seminar", Tab 7, "Advance Gas Turbine Materials and Coatings", P.W. Schilke, Aug. 1996.

"39$^{th}$ GE Turbine State–of–the–Art Technology Seminar", Tab 8, "Dry Low $NO_X$ Combustion Systems for GE Heavy–Duty Turbines", L. B. Davis, Aug. 1996.

(List continued on next page.)

*Primary Examiner*—Christopher Verdier
*Assistant Examiner*—James M McAleenan
(74) *Attorney, Agent, or Firm*—Nixon & Vanderhye

(57) ABSTRACT

An annular turbine shroud separates a hot gas path from a cooling plenum containing a cooling medium. Bumps are cast in the surface on the cooling side of the shroud. A surface coating overlies the cooling side surface of the shroud, including the bumps, and contains cooling enhancement material. The surface area ratio of the cooling side of the shroud with the bumps and coating is in excess of a surface area ratio of the cooling side surface with bumps without the coating to afford increased heat transfer across the element relative to the heat transfer across the element without the coating.

20 Claims, 2 Drawing Sheets

OTHER PUBLICATIONS

"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines," J. R. Johnsston Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. 1, "Industrial Advanced Turbine Systems Program Overview", D.W. Esbeck, pp. 3–13, Oct., 1995.
"Proceedings of the Advanced Turbine Systems Annual Program Review Meeting", vol. 1, "H Gas Turbine Combined Cycle", J. Corman, pp. 14–21, Oct., 1995.
"Proceedings of the Advanced Turbine Systems Annual Program Review Meeting", vol. 1, "Overview of Westinghouse's Advanced Turbine Systems Program", Bannister et al., pp. 22–30, Oct., 1995.
"Proceedings of the Advanced Turbine Systems Annual Program Review Meeting", vol. 1, "Allison Engine ATS Program Technical Review", D. Mukavetz, Oct., 1995.
"Proceedings of the Advanced Turbine Systems Annual Program Review Meeting", vol. 1, "Advanced Turbine Systems Program Industrial System Concept Development", S. Gates, pp. 43–63, Oct., 1995.
"Proceedings of the Advanced Turbine Systems Annual Program Review Meeting", vol. 1, "Advanced Turbine System Program Phase 2 Cycle Selection", Latcovich, Jr., pp. 64–69, Oct., 1995.
"Proceedings of the Advanced Turbine Systems Annual Program Review Meeting", vol. 1, "General Electric ATS Program Technical Review Phase 2 Activities", Chance et al., pp. 70–74, Oct., 1995.
"Proceedings of the Advanced Turbine Systems Annual Program Review Meeting", vol. 1, "Technical Review of Westinghouse's Advanced Turbine Systems Program", Diakunchak et al., pp. 75–86, Oct., 1995.
"Proceedings of the Advanced Turbine Systems Annual Program Review Meeting", vol. 1, "Advanced Combustion Turbines and Cycles: An EPRI Perspective", Touchton et al., pp. 87–88, Oct., 1995.
"Proceedings of the Advanced Turbine Systems Annual Program Review Meeting", vol. 1, "Advanced Turbine Systems Annual Program Review", William E. Koop, pp. 89–92, Oct., 1995.
"Proceedings of the Advanced Turbine Systems Annual Program Review Meeting", vol. 1, "The AGTSR Consortium: An Update", Fant et al., pp. 93–102, Oct., 1995.
"Proceedings of the Advanced Turbine Systems Annual Program Review Meeting", vol. 1, "Overview of Allison/AGTSR Interactions", Sy A. Ali, pp. 103–106, Oct., 1995.
"Proceedings of the Advanced Turbine Systems Annual Program Review Meeting", vol. 1, "Design Factors for Stable Lean Premix Combustion", Richards et al., pp. 107–113, Oct., 1995.
"Proceedings of the Advanced Turbine Systems Annual Program Review Meeting", vol. 1, "Ceramic Stationary as Turbine", M. van Roode, pp. 114–147, Oct., 1995.
"Proceedings of the Advanced Turbine Systems Annual Program Review Meeting", vol. 1, "Turbine Airfoil Manufacturing Technology", Kortovich, pp. 171–181, Oct., 1995.
"Proceedings of the Advanced Turbine Systems Annual Program Review Meeting", vol. 1, "Materials/Manufacturing Element of the Advanced Turbine Systems Program", Karnitz et al., pp. 152–160, Oct., 1995.
"Proceedings of the Advanced Turbine Systems Annual Program Review Meeting", vol. 1, "Land–Based Turbine Casting Initiative", Mueller et al., pp. 161–170, Oct., 1995.
"Proceedings of the Advanced Turbine Systems Annual Program Review Meeting", vol. 1, "Westinhouse Thermal Barrier Coatings", Goedjen et al., pp. 194–199, Oct., 1995.
"Proceedings of the Advanced Turbine Systems Annual Program Review Meeting", vol. 1, "High Performance Steam Development", Duffy et al., pp. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.
"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting", vol. II, The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496, Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_X$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, pp. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", Wililam D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_X$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 1996.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_X$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.

"Proceedings of the Advanced Turbine Systems Annual Program Review Meeting", "Ceramic Stationary Gas Turbine", Mark van Roode, pp. 633–658, Nov., 1996.

"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", " Status of Ceramic Gas Turbines in Russia", Mark van Roode, pp. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos. DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176–5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176–18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

ENHANCED HEAT TRANSFER SURFACE FOR CAST-IN-BUMP-COVERED COOLING SURFACES AND METHODS OF ENHANCING HEAT TRANSFER

This invention was made with Government support under Contract No. DE-FC21-95MC31176 awarded by the Department of Energy. The Government has certain rights in this invention.

BACKGROUND OF THE INVENTION

The present invention relates to a turbine element having a cast-in bump-covered cooling surface on one side and a coating overlying the cast-in bump surface to provide improved heat transfer between a coolant and the backside of the turbine element. The present invention also relates to methods for improving the heat transfer between the coolant and a turbine element having a cast-in bump-covered surface on one side.

Various techniques have been devised to maintain the temperature of turbine engine components below critical levels. As an example, a cooling medium, such as coolant air from the engine compressor is often directed to the component, along one or more component surfaces. Such flow is understood in the art as "backside air flow," where coolant air is directed at a surface of an engine component that is not directly exposed to high temperature gases from combustion. In combination with backside air flow, "turbulators" have been used to enhance heat transfer. Turbulators are protuberances or "bumps" on selected sections of the surface of the component, which function to increase the heat transfer between the cooling medium and the turbine element.

An example of the use of turbulators to enhance heat transfer is found on the impingement cooling side of a shroud encompassing the hot gas path of a turbine. It will be appreciated that the outer shroud of a gas turbine surrounds the hot gas path and is subject to very high temperatures on the hot gas path exposed side thereof. A cooling medium is conventionally disposed on the opposite side of the shroud from the hot gas path to cool the shroud wall. For example, in advanced turbine designs, the cooling medium may comprise steam which is directed onto the coolant side of the shroud wall through an impingement plate. The coolant side of the shroud wall has cast-in bumps generally cylindrical in shape and spaced from one another which provide a coolant side surface area which is larger than that of the base line smooth surface area. For example, the coolant side surface area ratio may be about 1.2. That is, the surface area of the coolant side of the surface with the cast-in bumps may be 1.2 times larger than the surface area of the coolant side of the element without the cast-in bumps. Improved heat transfer values, for example, 1.15 for jet Reynolds numbers ranging from 10,000 to 40,000 have been demonstrated. Heat transfer enhancement value is defined as the ratio of heat transfer from a surface with cast-in bumps to the heat transfer from a smooth surface.

It has been found that the processes employed for casting the bumps onto the surface of the element limit the dimensions of the cast-in bump geometries and the inter-bump spacing or pitch. As a consequence of these manufacturing process limitations, the heat transfer enhancement values for cast-in bump surfaces are limited. For example, it has been found very difficult to increase the heat transfer enhancement ratio beyond 1.4 using cast-in bumps on the coolant side of the element. Also, certain areas on the element are not amenable to receiving cast-in bumps, e.g., due to liquid metal filling issues and bump mold removal problems. Those areas may include mold joints, seams and bare spots for indexing/locating pins. Consequently, there is a need to provide enhanced heat transfer characteristics beyond those afforded by cast-in bumps on the coolant side of the element.

BRIEF SUMMARY OF THE INVENTION

In accordance with a preferred embodiment of the present invention, cooling enhancement material is applied to the cooling side of the element in overlying relation to the cast-in bumps and the spaces between the bumps. Preferably, a coating containing particles, e.g., formed of metal particles, is applied to the cooling surface of the element overlying the cast-in bumps and spaces therebetween. Preferably, a green braze tape coated with a metallic powder is set in intimate contact with the cooling surface with cast-in bumps and then brazed in a vacuum oven. The size of the metallic powder particles is selected to provide a heat transfer enhancement ratio larger than that provided by the bumps per se. For example, metallic particle sizes in a range of 1 to 20 mils may be used. A coating formed with metallic particles having diameters of 15 mils has resulted in impingement heat transfer enhancement values from 1.3 to 1.8 for the range of Reynolds numbers between about 10,000 and 50,000. With the brazed rough coating of cooling enhancement material applied to the coolant side of the element, the increased impingement heat transfer can be used to reduce the metal temperatures of the element and increase its expected life; to increase the hot gas side temperatures, hence increasing overall efficiency of the turbine; and reduced cooling flow requirements, hence reducing compressor discharge air used for cooling and increasing efficiency. It will also be appreciated that the coating with the cooling enhancement material does not significantly increase the pressure drop in comparison with the pressure drop with cast-in bump surfaces alone and, consequently, there is no significant pressure drop penalty for the use of brazed microturbulators. One method of increasing heat transfer characteristics in this embodiment is described in co-pending U.S. patent application Ser. No. 09/304,276, filed May 3, 1999, of common assignee herewith.

In a preferred embodiment according to the present invention, there is provided turbine component comprising an element separating a high-temperature region and a cooling medium from one another, the element on a cooling medium side thereof having a surface with discrete bumps separated from one another and projecting from the surface, the surface with the discrete bumps defining a predetermined ratio of the area of the surface with the bumps and the area of the surface without the bumps, a surface coating on the cooling side of the element overlying the surface with discrete bumps forming a cooling side surface having a ratio of the area of the coated surface with the bumps and the area of the surface with the bumps without the coating in excess of the predetermined surface area ratio to afford increased heat transfer between the cooling medium and the element relative to the heat transfer between the cooling medium and element without the coating.

In a further preferred embodiment according to the present invention, there is provided a method of enhancing the heat transfer between an element having a surface with cast bumps projecting from the surface and a cooling medium, the surface with the cast bumps defining a predetermined surface area ratio comprising the steps of applying a coating on the surface to overlie the cast bumps and areas on the surface between the cast bumps to form a coated surface having a surface area ratio in excess of the predetermined surface area ratio to afford increased heat transfer between the element and the cooling medium relative to the heat transfer between the element and the cooling medium without the coating.

In a still further preferred embodiment according to the present invention, there is provided a method of enhancing the heat transfer between an element having a surface with cast bumps projecting from the surface and a cooling medium, comprising the steps of providing a brazing sheet having cooling enhancement material and fusing the brazing sheet to the surface including the cast bumps such that the cooling enhancement material is bonded to the surface.

DETAILED DESCRIPTION OF THE INVENTION

Figure 1:
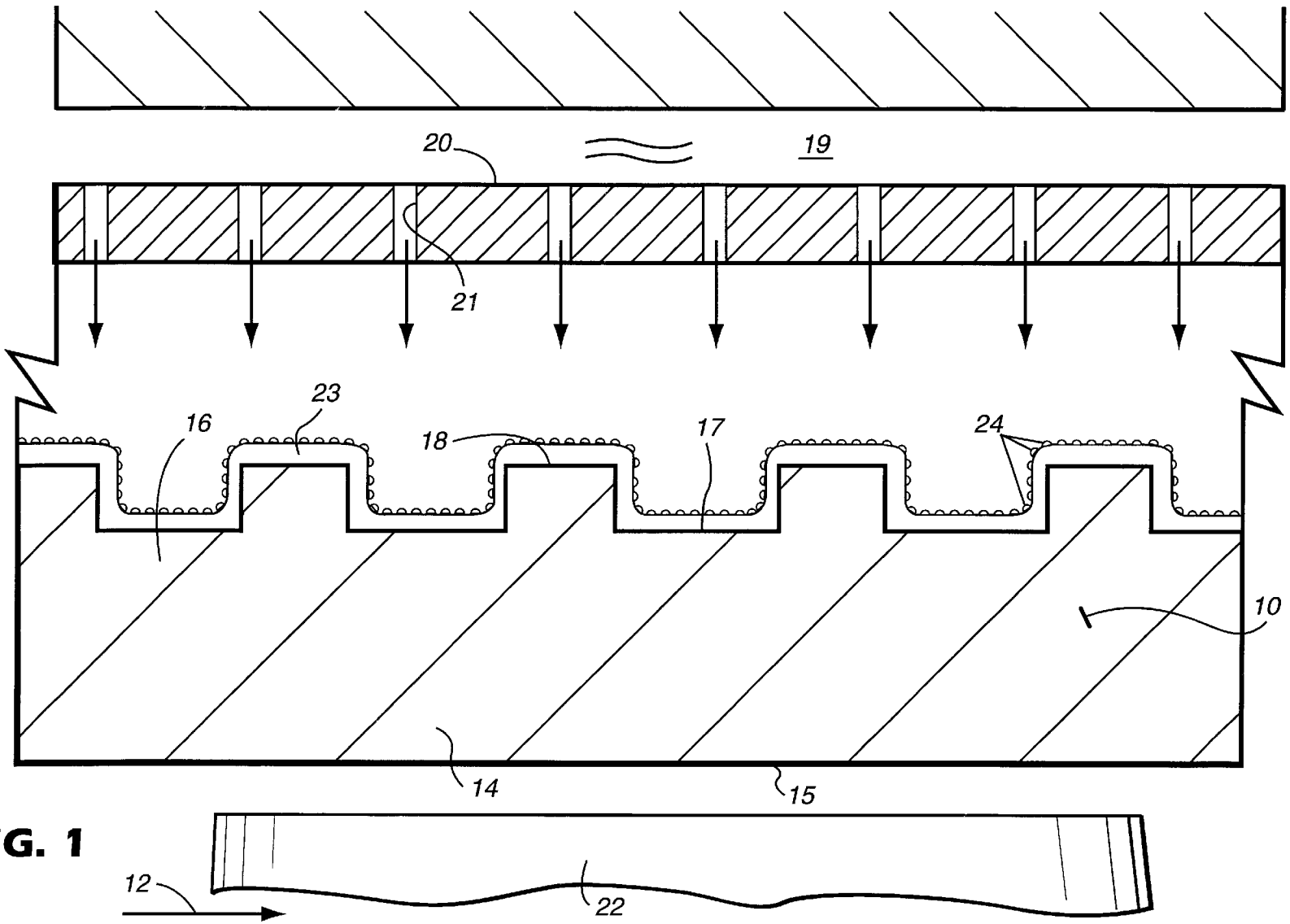
FIG. 1 is a partial side cross-sectional view of a shroud having a cast-in bump on a coolant side and illustrated with an impingement plate.
Figure 2:
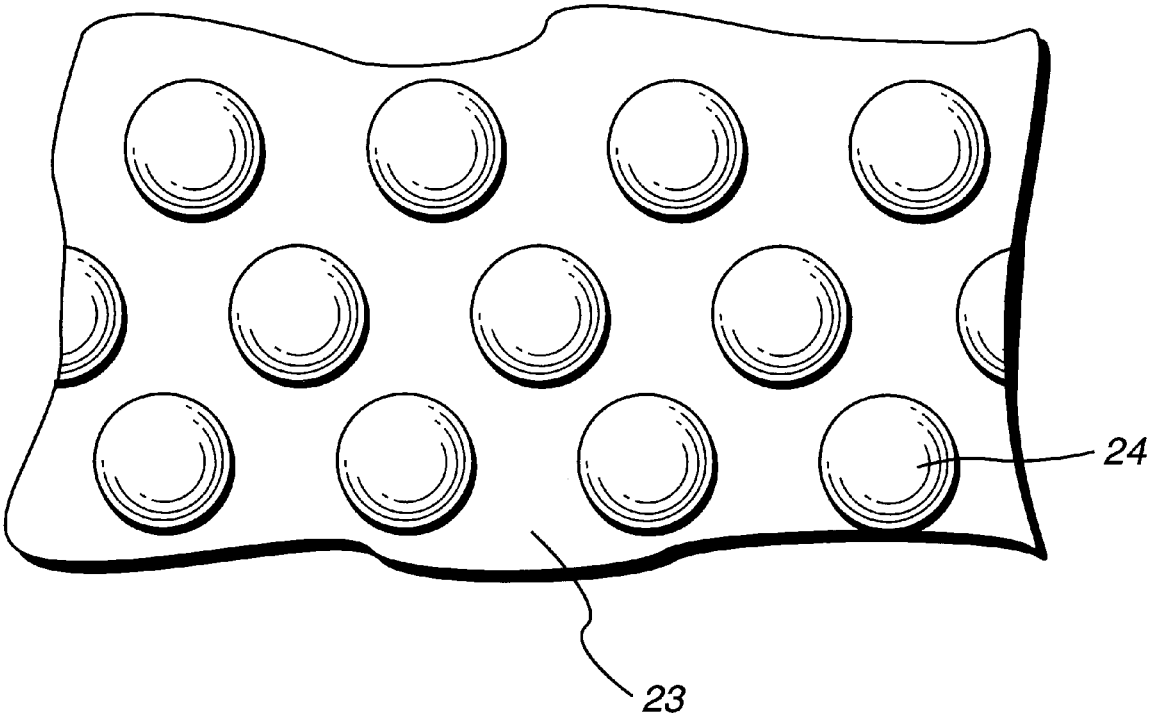
FIG. 2 is a plan view of the coolant side surface of the shroud illustrated in FIG. 1.

The present rough coating can be used with any metallic material or alloy, but is usually used with heat-resistant alloys designed for high-temperature environments, such as above 1000° C. As defined herein, "metal-based" refers to substrates that are primarily formed of metal or metal alloys. Some heat-resistant alloys are "superalloys" including cobalt-based, nickel-based, and iron-based alloys. In one embodiment, the superalloy is nickel or cobalt based, wherein nickel or cobalt is the single greatest element by weight. Illustrative nickel-based alloys include at least about 40 wt % Ni, and at least one component from the group consisting of cobalt, chromium, aluminum, tungsten, molybdenum, titanium, and iron. Examples of nickel-based superalloys are designated by the trade names Inconel®, Nimonic®, Rene® (e.g., Rene®80-, Rene®95 alloys, Rene® 142 and Rene® N5), and Udimet®, and include directionally solidified and single crystal superalloys. Illustrative cobalt-based alloys include at least about 30 wt % Co, and at least one component from the group consisting of nickel, chromium, aluminum, tungsten, molybdenum, titanium, and iron. Examples of cobalt-based superalloys are designated by the trade names Haynes®, Nozzaloy®, Stellite® and Ultimet®.

According to embodiments of the present invention, a layer of material containing at least a braze alloy component and a cooling enhancement material is utilized to provide cooling enhancement on a surface of a substrate, particularly on a superalloy substrate. As used herein, the term "layer" of material is used to denote a single layer or several discrete sub-layers that are sandwiched together. A "layer" of material may have several phases, including a matrix phase having a discrete phase dispersed therein, and several phases defined by sub-layers. The layer of material may be in the form of a free-standing sheet containing at least the cooling enhancement material and the braze alloy component. As used herein, "cooling enhancement material" is a material that, upon fusing to a substrate, forms a plurality of protuberances that extend beyond the surface of the substrate. These plurality of protuberances together define a "surface area enhancement," which appears as a roughened surface that is effective to increase heat transfer through the treated substrate. According to several embodiments of the present invention, the cooling enhancement material comprises a particulate phase comprised of discrete particles bonded to the substrate. The particulate phase of discrete particles may be formed from a coarse powder, described in more detail below with respect to embodiments herein. While not intended to be bound by any theory of operation, it is believed that the cooling enhancement is a function of the increased surface area with the cooling enhancement material applied to the cast-in bumps as well as turbulation caused by the bumps and applied cooling enhancement material.

In one embodiment of the invention, the layer of material is a brazing sheet, particularly a green braze tape. Such tapes are commercially available. In an embodiment, the green braze tape is formed from a slurry of metal powder and binder in a liquid medium such as water or an organic liquid. The liquid medium may function as a solvent for the binder. The metal powder is often referred to as the "braze alloy."

The composition of the braze alloy is preferably similar to that of the substrate. For example, if the substrate is a nickel-based superalloy, the braze alloy can contain a similar nickel-based superalloy composition. In the alternative, nickel-based braze alloys or cobalt-based braze alloys are usually used with cobalt-based superalloys. Nickel- or cobalt-based compositions generally denote compositions wherein nickel or cobalt is the single greatest element in the composition. The braze alloy composition may also contain silicon, boron, phosphorous or combinations thereof, which serve as melting point suppressants. It is noted that other types of braze alloys can be used, such as precious metal compositions containing silver, gold, or palladium, mixtures thereof, in combination with other metals, such as copper, manganese, nickel, chrome, silicon, and boron. Mixtures that include at least one of the braze alloy elements are also possible. Exemplary braze alloys include by weight percent, 2.9 boron, 92.6 nickel, 4.5 tin; 3.0 boron, 7.0 chromium, 3.0 iron, 83.0 nickel, and 4.0 silicon; 19.0 chromium, 71.0 nickel, and 10.0 silicon; 1.8 boron, 94.7 nickel, and 3.5 silicon.

A variety of materials are generally used as binders in the slurry for forming the green braze tape. Non-limiting examples include water-based organic materials, such as polyethylene oxide and various acrylics. Solvent-based binders can also be used. Additional organic solvent (e.g., acetone, toluene, or various xylenes) or water may be added to the slurry to adjust viscosity.

The slurry is usually tape cast onto a removable support sheet, such as a plastic sheet formed of a material such as Mylar®. A doctor-blade apparatus can be used for tape-casting. Substantially all of the volatile material in the slurry is then allowed to evaporate. The resulting braze alloy tape usually has a thickness in the range of about 1 micron to about 250 microns, and preferably, in the range of about 25 microns to about 125 microns.

Braze tapes containing the above-mentioned braze alloy and binder are commercially available. An example of a commercial product is the Amdry line of braze tapes, available from Sulzer Metco. An exemplary grade is Amdry® 100.

The cooling enhancement material that is applied to the green braze tape is typically a coarse powder, being formed of particles having a size sufficient to form protuberances that function to increase heat transfer of the treated component. In many embodiments, the size of the particles is determined in large part by the desired degree of surface roughness and surface area (and consequently, heat transfer)

that will be provided by the protuberances. Surface roughness is characterized herein by the centerline average roughness value "Ra," as well as the average peak-to-valley distance "Rz" in a designated area as measured by optical profilometry. According to an embodiment, Ra is greater than about 0.1 mils, such as greater than about 1.0 mils, and preferably greater than about 2.0 mils. Ra is typically less than about 25 mils, more typically less than about 10 mils. Similarly, according to an embodiment, Rz is greater than about 1 mil, such as greater than about 5 mils. Rz is typically less than about 100 mils, more typically less than about 50 mils. As used herein, the term "particles" may include fibers, which have a high aspect ratio, such as greater than 1:1. In one embodiment, the average size of the cooling enhancement powder particles is in the range of about 125 to about 4000 microns, such as about 150 to about 2050 microns. In a preferred embodiment, the average size of the powder particles is in the range of about 180 microns to about 600 microns.

The cooling enhancement material is often formed of a material similar to that of the substrate metal, which is in turn similar to that of the braze alloy. The cooling enhancement powder, however, may have a higher melting point or softening point than that of the braze alloy such that the powder remains largely intact through the fusing operation. Usually, the powder comprises at least one element selected from the group consisting of nickel, cobalt, aluminum, chromium, silicon, iron, and copper. The powder can be formed of a superalloy bond coat composition for thermal barrier coating (TBC) systems, such as a superalloy composition of the formula MCrAlY, where "M" can be various metals or combinations of metals, such as Fe, Ni, or Co. The MCrAlY materials generally have a composition range of about 17.0–23.0% chromium; about 4.5–12.5% aluminum; and about 0.1–1.2% yttrium; with M constituting the balance.

However, it should be emphasized that an important advantage of the present process relates to the ability to change the surface "chemistry" of selected portions of the substrate by changing the composition of the cooling enhancement material. For example, the use of oxidation-resistant or corrosion-resistant metal alloys for such material will result in a turbulated surface that exhibits those desirable properties. As another illustration, the thermal conductivity of the cooling enhancement material, which affects the heat transfer, can be increased by using a material with a high thermal conductivity, such as nickel aluminide which has a thermal conductivity on the order of 450 $Btu \cdot in/ft^2 \cdot hF$ . In one embodiment, the cooling enhancement powder is formed of a material having a thermal conductivity greater than about 60 $Btu \cdot in/ft^2 \cdot hF$, preferably greater than about 80 $Btu \cdot in/ft^2 \cdot hF$, such as greater than about 130 $Btu \cdot in/ft^2 \cdot hF$. In contrast, prior art casting techniques for producing turbulation usually employ only the base metal material for the protuberances, thereby limiting flexibility in selecting the characteristics of the turbulated surface.

The powder can be randomly applied by a variety of techniques, such as sprinkling, pouring, blowing, roll-depositing, and the like. The choice of deposition technique will depend in part on the desired arrangement of powder particles, to provide the desired pattern of protuberances. As an example, metered portions of the powder might be sprinkled onto the tape surface through a sieve in those instances where the desired pattern-density of the protuberances is relatively low.

Usually, an adhesive is applied to the surface of the green braze tape prior to the application of the cooling enhancement powder thereon. Any braze adhesive can be used, so long as it is capable of completely volatilizing during the subsequent fusing step. Illustrative examples of adhesives include polyethylene oxide and acrylic materials. Commercial examples of braze adhesives include "4B Braze Binder," available from Cotronics Corporation. The adhesive can be applied by various techniques. For example, liquid-like adhesives can be sprayed or coated onto the surface. A thin mat or film with double-sided adhesion could alternatively be used, such as 3M Company's 467 Adhesive Tape.

In one embodiment, prior to being brazed, the powder particles are shifted on the tape surface to provide the desired alignment that would be most suitable for heat transfer. For example, acicular particles, including fibers, having an elongated shape may be physically aligned so that their longest dimension extends substantially perpendicular to the surface of the brazing sheet contacting the substrate. The alignment of the powder may be carried out by various other techniques as well. For example, a magnetic or electrostatic source may be used to achieve the desired orientation. In yet another embodiment, individual particles or clusters of particles are coated with braze alloy, and such coated particles are placed on an adhesive sheet for application to a substrate. The adhesive sheet can be formed of any suitable adhesive, provided that it is substantially completely burned-out during the fusing operation. Suitable adhesives are discussed above.

In some embodiments, the cooling enhancement powder is patterned on the surface of the braze sheet. Various techniques exist for patterning. In one embodiment, the powder is applied to the substrate surface through a screen, by a screen printing technique. The screen would have apertures of a pre-selected size and arrangement, depending on the desired shape and size of the protuberances. Alternatively, the braze adhesive is applied through the screen and onto the sheet. Removal of the screen results in a patterned adhesive layer. When the powder is applied to the sheet, it will adhere to the areas that contain the adhesive. By use of a screen, a pattern may be defined having a plurality of "clusters" of particles, wherein the clusters are generally spaced apart from each other by a pitch corresponding to the spacing of the openings in the screen. The excess powder can easily be removed, leaving the desired pattern of particles. As another alternative, a "cookie cutter" technique may be employed, wherein the braze tape is first cut to define a desired turbulation pattern, followed by removal of the excess braze tape. The powder can then be applied to the patterned tape. In yet another embodiment, particles of the turbulation material are coated with braze alloy, and the coated particles are adhered onto an adhesive sheet that volatilizes during the fusing step. Here, the adhesive sheet provides a simple means for attachment of the cooling enhancement material to the substrate prior to fusing, but generally plays no role in the final, fused article.

In another embodiment, the turbulation powder is mixed with the other components of the green braze tape, such as braze alloy powder, binder and solvent, during formation of the green braze tape, rather than providing the powder on a surface of the already formed tape. The powder in turn forms a dispersed particulate phase within the green braze tape.

The removable support sheet, such as Mylar® backing is then detached from the green braze tape. The tape is then attached to a portion of the component-substrate where turbulation is desired. A simple means of attachment is used in some embodiments. The green braze tape can be placed on a selected portion of the substrate, and then contacted with a solvent that partially dissolves and plasticizes the binder, causing the tape to conform and adhere to the substrate surface, i.e., the tape flows to match the contours of the cast bumps. As an example, toluene, acetone or another organic solvent could be sprayed or brushed onto the braze tape after the tape is placed on the substrate.

Following application of the green braze tape to the substrate, the cooling enhancement material is fused to the substrate. The fusing step can be carried out by various techniques, such as brazing and welding. Generally, fusing is carried out by brazing, which includes any method of joining metals that involves the use of a filler metal or alloy. Thus, it should also be clear that braze tapes and braze foils can be used in fusing processes other than "brazing." Brazing temperatures depend in part on the type of braze alloy used, and are typically in the range of about 525° C. to about 1650° C. In the case of nickel-based braze alloys, braze temperatures are usually in the range of about 800° C. to about 1260° C.

When possible, brazing is often carried out in a vacuum furnace. The amount of vacuum will depend in part on the composition of the braze alloy. Usually, the vacuum will be in the range of about $10^{-1}$ torr to about $10^{-8}$ torr, achieved by evacuating ambient air from a vacuum chamber to the desired level.

In the case of cooling enhancement material being applied to an area which does not lend itself to the use of a furnace, such as when the component itself is too large to be inserted into a furnace, a torch or other localized heating means can be used. For example, a torch with an argon cover shield or flux could be directed at the brazing surface. Specific, illustrative types of heating techniques for this purpose include the use of gas welding torches (e.g., oxy-acetylene, oxy-hydrogen, air-acetylene, air-hydrogen); RF (radio frequency) welding; TIG (tungsten inert-gas) welding; electron-beam welding; resistance welding; and the use of IR (infrared) lamps.

The fusing step fuses the brazing sheet to the substrate. When the braze material cools, it forms a metallurgical bond at the surface of the substrate, with the turbulation material mechanically retained within the solidified braze matrix material.

In the embodiments described above, the structure of the component after-fusing includes a solidified braze film that forms a portion of the outer surface of the component, and protuberances that extend beyond that surface. The protuberances are generally made up of a particulate phase comprised of discrete particles. The particles may be arranged in a monolayer, which generally has little or no stacking of particles, or alternatively, clusters of particles in which some particles may be stacked on each other. Thus, after fusing, the treated component has an outer surface defined by the film of braze alloy, which has a particulate phase embedded therein. The film of braze alloy may form a continuous matrix phase. As used herein, "continuous" matrix phase denotes an uninterrupted film along the treated region of the substrate, between particles or clusters of particles. Alternatively, the film of braze alloy may not be continuous, but rather, be only locally present to bond individual particles to the substrate. In this case, the film of braze alloy is present in the form of localized fillets, surrounding discrete particles or clusters of particles. In either case, thin portions of the film may extend so as to coat or partially coat particles of the powder.

As an illustrative example of the use of a rough coating of the foregoing-described type to enhance heat transfer, and referring to FIG. 1, there is illustrated an element 10 forming a part of a wall in a gas turbine. The element 10, for example, may comprise a wall separating a high temperature region and a cooling region from one another. In a preferred embodiment, the element 10 may comprise an annular wall surrounding a hot gas path through a turbine, the high temperature region, e.g., the hot gas path being indicated by the arrow 12. The element 10 thus may form a shroud comprising a hot side 14 having a hot side surface 15 and a cooling region, e.g., a coolant side 16 having a coolant side surface 17. Cast-in bumps 18, generally in the nature of cylindrical projections 18, are provided on the coolant side surface 17 of the shroud 10. The cast bumps 18 are provided on the coolant side of the shroud to provide a surface area larger than the surface area of the coolant side surface without the bumps 18 to afford increased heat transfer values. Thus, the shroud wall surface with cast-in bumps has a predetermined surface area ratio, i.e., a ratio of the surface area with the cast-in bumps to the surface area without the cast-in bumps, for example, on the order of 1.2. In a typical shroud wall cooling system, impingement plate 20 is spaced from the coolant side 16 of the shroud 10 for flowing an impingement cooling medium from a plenum 19 through apertures 21 in the impingement plate 20 against the coolant side surface 17 of the shroud 10. The cooling medium may comprise, for example, steam. The tip of a turbine bucket 22 is illustrated in FIG. 1 in the hot gas path and spaced from the hot side surface 15 of the shroud 10.

In accordance with a preferred embodiment of the present invention, a surface coating 23 is applied on the cooling side of the shroud 10 overlying the cast-in bumps 18 and the spaces therebetween. The coating may be of the type as previously described, e.g., comprises a braze alloy and a roughness producing cooling enhancement material 24. The material 24 in the coating preferably comprises metallic particles bonded to the substrate formed by the shroud wall and the cast-in bumps 18. With the material and the coating, the surface area ratio, i.e., the surface area with the coating and cooling enhancement material divided by the surface area without the material and coating (on the coolant side wall of the shroud 10 including the bumps 18) is in excess of the first surface area ratio and affords enhanced heat transfer values. Thus, the heat transfer enhancement value of the surface coated with the coating and protuberances fused to the surface is greater than the heat transfer value of the surface with cast-in bumps without the coating. It will be appreciated that the coating may be applied in accordance with any of the techniques described previously to form a brazed alloy coating that forms a continuous matrix phase and a discrete particulate phase comprised of cooling enhancement. The articles may be randomly arranged or arranged in a predetermined pattern, as discussed.

The average height of the protuberances as measured from the substrate is generally on the order of the average particle size of the particles of the turbulation material, such as about 125 microns to about 4000 microns or about 150 microns to about 2050 microns. The height may also be within a range of about 180 to about 600 microns. The thickness of the braze alloy film 24 overlying the substrate is generally chosen to ensure adequate roughness and ensure an increase in surface area, provided by the particulate phase, while also ensuring adequate adhesion of the particles to the substrate. The thickness may be on the order of about 20 microns to 100 microns, more particularly, 30 to 70 microns. In one embodiment, the thickness is approximately 50 microns.

The application of turbulation material according to embodiments of the present invention is effective to increase surface area of the substrate. For example, $A/A_0$, where A is the surface area of the treated region of the component and $A_0$ is the surface area of the same region of the component in untreated form, i.e., the coolant side surface 16 of shroud 10 with the cast-in bumps 18, is at least about 1.2 and generally from 1.5 to 2.4 for the powder size used. However, $A/A_0$ up to 3.0 is attainable.

In most embodiments, the turbulation (i.e., the "roughness" provided by the protuberances) is present to enhance the heat transfer characteristics for the underlying component. The enhanced heat transfer characteristics in turn result in a desirable temperature reduction for specified regions of the component, leading to a desirable reduction in thermal stress. Moreover, by tailoring the size and spacing of the protuberances, the heat transfer enhancement can also be adjusted, which in turn results in a reduction in the thermal and stress gradients for the component.

Embodiments of the present invention have shown improvement in heat transfer over wire-sprayed turbulation. For example, embodiments of the present invention have provided a heat transfer enhancement value within a range of 1.3 to 1.8 for metal particle sizes having diameters of 13 mils at jet Reynolds numbers of about 10,000 to 50,000.

According to embodiments of the present invention, by keeping the particles close to the surface of the substrate, pressure drop of the coolant medium flow across the cooled surface is reduced and the fin cooling efficiency is improved. For example, in one embodiment, the height of the particles is kept below 600 microns, more particularly, less than about 375 microns. The particle size may be less than about 600 microns, more particularly, less than about 375 microns to ensure that such turbulation material is close to the surface to improve fin efficiency.

As described above, the term "turbulation" has been used to denote a roughened surface comprised of a plurality of protuberances or particles that are effective to increase heat transfer through a treated component. The roughened surface in some embodiments appears sandpaper-like in appearance. The increase in heat transfer is believed to be largely due to the increased surface area of the treated component. Turbulation may also increase heat transfer by modifying the coolant medium flow characteristics, such as from laminar flow to turbulated flow along the surface, particularly where the material is principally formed of large particle size material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine component comprising an element separating a high-temperature region and a cooling medium from one another, said element on a cooling medium side thereof having a surface with discrete bumps separated from one another and projecting from said surface, said surface with said discrete bumps defining a predetermined ratio of the area of said surface with said bumps and the area of said surface without said bumps, a surface coating on said cooling medium side of said element overlying said surface with discrete bumps forming a cooling side surface having a ratio of the area of said coated surface with said bumps and the area of said surface with said bumps without said coating in excess of said predetermined surface area ratio to afford increased heat transfer between the cooling medium and the element relative to the heat transfer between the cooling medium and the element without said coating.

2. A component according to claim 1 wherein said coating includes a metallic powder brazed onto said cooling side of said element.

3. A component according to claim 2 wherein said metallic powder includes particles having a size ranging between 1–20 mils in diameter.

4. A component according to claim 1 wherein said element comprises an annular shroud separating a hot gas path through a turbine and a cooling plenum on an opposite side of the shroud from the hot gas path.

5. A component according to claim 4 wherein said shroud includes an impingement plate for impingement cooling the cooling side of said shroud.

6. A component according to claim 1 wherein said coating includes cooling enhancement material bonded to said cast surface by a bonding agent.

7. A component according to claim 6 wherein said cooling enhancement material extends beyond said cast surface and forms a plurality of protuberances, said bonding agent comprising a braze alloy.

8. A component according to claim 7 wherein said braze alloy forms a layer on said surface and said cooling enhancement material is embedded in the layer of brazed alloy.

9. A component according to claim 1 wherein said coating comprises a brazing sheet including a braze alloy and cooling enhancement material including metal particles.

10. A component according to claim 9 wherein said brazing sheet comprises a green brazed tape.

11. A component according to claim 9 wherein the average particle size is within a range of 150 microns to about 2,050 microns, the cooling enhancement material comprising at least one component from the group consisting of nickel, cobalt, aluminum, chromium, silicon, iron and copper.

12. A component according to claim 9 wherein the cooling enhancement material has the composition MCrAlY, wherein M is selected from a group consisting of iron, cobalt and nickel.

13. A component according to claim 9 wherein the braze alloy comprises at least one metal from a group consisting of nickel, cobalt, iron, a precious metal and a mixture thereof.

14. A component according to claim 1 wherein said element and bumps thereon are formed of a cast material.

15. A method of enhancing the heat transfer of an element having a surface with cast bumps projecting from the surface, said surface with said cast bumps defining a predetermined surface area ratio comprising the steps of:

applying a coating on said surface to overlie said cast bumps and areas on said surface between said cast bumps to form a coated surface having a surface area ratio in excess of said predetermined surface area ratio to afford increased heat transfer across said element relative to the heat transfer across said element without said coating.

16. A method according to claim 15 wherein the coating comprises a braze alloy and cooling enhancement material, and including the further step of fusing the braze alloy on the surface to bond the cooling enhancement material to the surface.

17. A method according to claim 15 wherein said coating includes a brazing sheet having a braze alloy and a binder and said cooling enhancement material includes metal particles.

18. A method of enhancing the heat transfer of an element having a surface with cast bumps projecting from said surface, comprising the steps of:

providing a brazing sheet having cooling enhancement material; and fusing the brazing sheet to said surface including said cast bumps such that said cooling enhancement material is bonded to said surface.

19. A method according to claim 18 including fusing the brazing sheet to said surface such that the cooling enhancement material forms protuberances projecting from said surface.

20. A method according to claim 18 wherein said brazing sheet comprises a green braze tape having first and second surfaces on opposite sides thereof, said cooling enhancement material being applied to said second surface of said tape and fusing the green tape to said surface with cast-in bumps with said first surface of said green tape being applied to said cast-in bumps.

* * * * *